United States Patent [19]

Bergman

[11] 4,026,643

[45] May 31, 1977

[54] APPARATUS AND METHOD FOR MEASUREMENT OF THE RATIO OF TONER PARTICLE ELECTROSTATIC CHARGE TO TONER PARTICLE MASS IN ELECTROSTATOGRAPHIC DEVICES

[75] Inventor: Norman J. Bergman, Webster, N.Y.

[73] Assignee: Xerox Corporation, Stamford, Conn.

[22] Filed: Aug. 22, 1975

[21] Appl. No.: 606,898

[52] U.S. Cl. ..... 355/3 DD; 118/8; 118/646; 355/14

[51] Int. Cl.[2] ..... G03G 15/00

[58] Field of Search ..... 355/3 R, 3 DD, 14, 17; 118/637, 7, 8; 324/72, 32

[56] References Cited

UNITED STATES PATENTS

| | | | |
|---|---|---|---|
| 3,674,353 | 7/1972 | Trachtenberg | 355/3 DD |
| 3,779,204 | 12/1973 | Altmann | 324/72 |
| 3,821,938 | 7/1974 | Bacon et al. | 118/7 |
| 3,872,825 | 3/1975 | Davidson | 355/3 DD |

*Primary Examiner*—L. T. Hix
*Assistant Examiner*—J. A. LaBarre

[57] ABSTRACT

Apparatus and method for measurement of the ratio of the triboelectric toner particle charge to the toner particle mass in electrostatographic apparatus. The ratio of the toner particle charge to the toner particle mass is determined by combining a measurement of the difference between the electrostatic photoreceptor potential in the presence and in the absence of charged toner particles with a measurement of a difference in optical reflectance in the presence and in the absence of charged toner particles. The measurement of the difference in the electrostatic potential of the photoreceptor provides a quantity proportional to the toner particle charge per unit area. The measurement of the difference in optical reflectance provides a quantity related to the toner mass per unit area, a quantity that is linear for low particle densities. Combining the two difference measurements provides a quantity proportional to the toner charge per toner mass.

Apparatus is disclosed for deriving a signal related to the toner charge to toner mass during electrostatographic processing and providing a feed back control signal for maintaining the ratio of the toner particle charge to toner particle mass in an acceptable range by controlling the ratio of the toner particles and the carrier particles in the developer mixture.

12 Claims, No Drawings

APPARATUS AND METHOD FOR MEASUREMENT OF THE RATIO OF TONER PARTICLE ELECTROSTATIC CHARGE TO TONER PARTICLE MASS IN ELECTROSTATOGRAPHIC DEVICES

This invention relates generally to the development of latent electrostatic images on a photoreceptor device and more particularly to the measurement of the ratio of toner particle electrostatic charge to toner particle mass for the toner particle material employed in the latent electrostatic image development. A signal related to the electrostatic charge to mass toner ratio measurement can be utilized as a portion of the control of the image development process.

An important parameter in the development of latent electrostatic images is the ratio of electrostatic charge to mass of the toner particle portion of the image development material. For example, a typical development material can be comprised of at least a toner or coloring particle component and a carrier component. The charge to mass ratio, however, can be altered by changes in humidity, aging and a variety of other phenomna. Thus variables over which little control can be maintained, influence the quality of electrostatic image development. It is known in the prior art that a portion of the toner particle component of the development material can be extracted from the apparatus developing the electrostatic images and the electrostatic charge and mass of the toner component measured. In addition to the undesirable requirement for an operator to perform requisite measurements, this procedure does not lend itself to automatic control of the latent image development process. It is desirable to obtain a measurement of the toner particle electrostatic charge to mass ratio during latent image development operation. A test procedure can be interspersed periodically in the image development operation and any undesirably large excursions of the electrostatic charge to mass ratio can be identified and appropriate compensation can be instituted.

It is, therefore, an object of the present invention to provide an improved electrostatographic reproduction apparatus.

It is a further object of the present invention to provide apparatus and method for improved development of latent electrostatic images.

It is another object of the present invention to provide apparatus for determination of electrostatic charge to mass ratio of the toner particle component during development of a latent electostatic image.

It is a more particular object of the present invention to provide for a measurement of the change in electrostatic potential of a photoreceptor surface resulting from addition of charged toner particles and form a measurement of the charge in reflectance of the photoreceptor surface resulting from the addition of toner particles.

It is another particular object of the present invention to measure the ratio of electrostatic charge to mass of toner particle material utilizing apparatus for measuring a difference in the potential and in the reflectance of a photoreceptor surface resulting from the addition of toner particle material.

It is still another object of the present invention to provide apparatus and method controlling the electrostatic charge to mass ratio of toner particle material utilized in development of electrostatic latent images.

The aforementioned and other objects are accomplished, according to the present invention, by providing apparatus for measuring the electrostatic potential of a photoreceptor surface before and after the application of charged toner particle development material and for measuring the reflectance of the photoreceptor surface before and after the application of the toner particle material. The measurement of the difference in the electrostatic potential and in the reflectance of the photoreceptor surface in the presence and the absence of the toner particle development material can be combined to produce a measurement proportional to the electrostatic charge to mass ratio of the toner particle material. The apparatus measuring a quantity proportional to the electrostatic charge to mass ratio can be activated during the electrostatographic processing operation to provide current information concerning changes in the ratio. By simultaneous direct measurement of the electrostatic charge and mass of toner particle material, the constant of proportionality can be experimentally estimated.

The measured electrostatic charge to mass ratio of the toner particle material can be used to monitor the relevant portion of the electrostatographic processing operation. Upon determination of a sufficiently large excursion of the measured value from an optimum value, the processing operation (e.g. the ratio of toner to carrier components of the development material) can be adjusted either manually or by automatic feedback control means to return the measured electrostatic charge to mass ratio to a value within predetermined limits.

These and other features of the invention will be understood upon reading of the following description along with the drawings.

Figure 1:
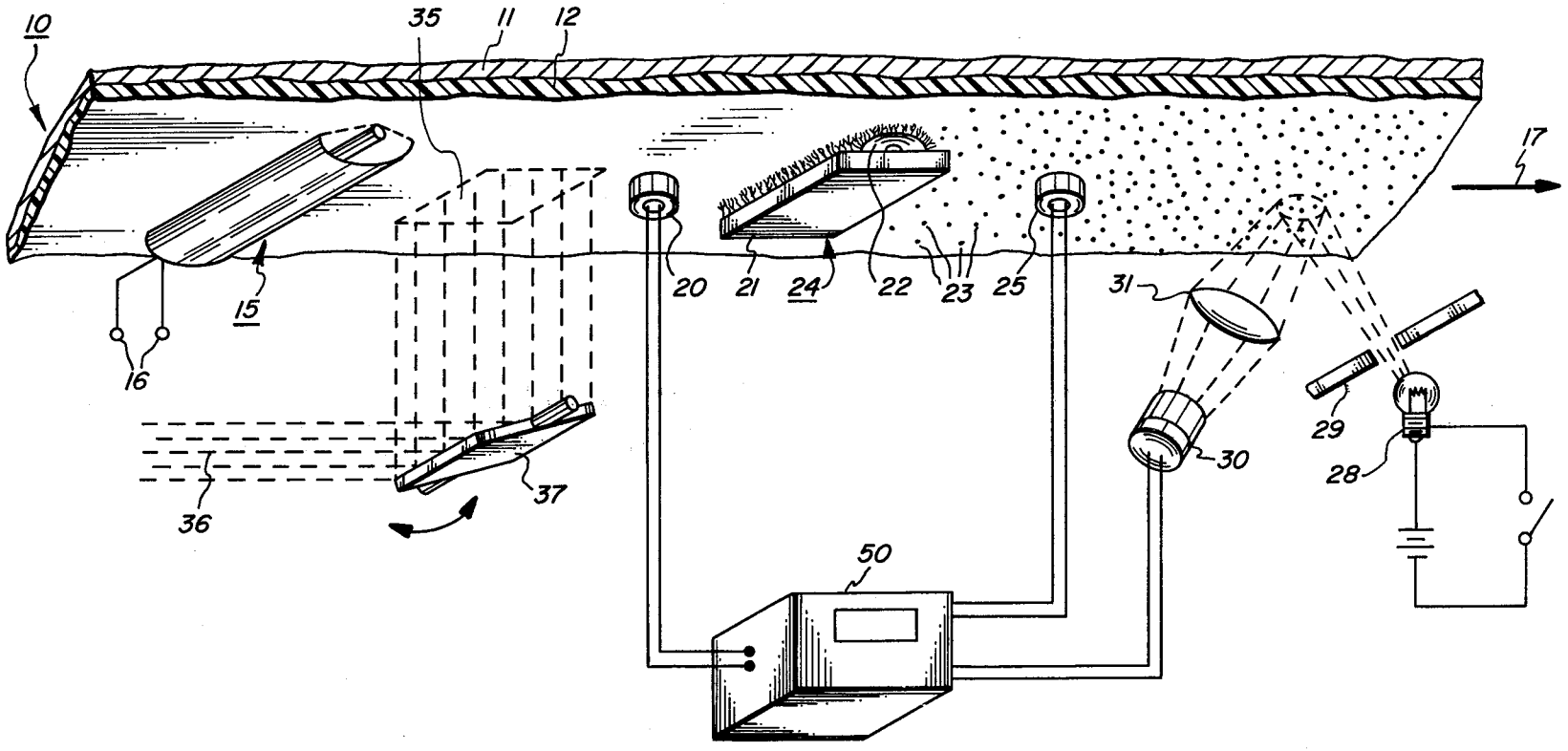
FIG. 1 is a perspective drawing of apparatus for measuring the electrostatic potential of a photoreceptor surface and the reflectance of the photoreceptor surface in the presence and in the absence of charged toner particles on the photoreceptor surface according to the present invention.

Referring now to FIG. 1, a perspective drawing of an idealized arrangement for measuring quantities utilized in determining the electrostatic charge to mass ratio is shown. A portion of photoreceptor 10, moving in a direction indicated by the arrow 17 shown. For ease of illustration, the photoreceptor 10 is shown in a linear configuration. It will be clear, however, that this linear photoreceptor portion can represent a portion of a drum or a portion of a photoreceptor belt having alternations in direction. The photoreceptor 10 is suitable for storing electrostatic charge and is comprised of at least a conductor 11 and a photoconductor material 12.

After suitable preparation of the surface of the photoreceptor, the photoreceptor is passed in the vicinity of a device such as corotron 15 for imparting electostatic charge on the surface of the photoreceptor. Suitable potentials are applied to terminals 16 in order that a generally uniform electrostatic charge is deposited on the photoreceptor surface.

The charged photoreceptor surface is transported to the vicinity of sensor 20. Sensor 20 is comprised, in the preferred embodiment, of a electrometer probe. The electrometer probe, and associated electronic circuits included in apparatus 50, measure the potential of the charged surface of photoreceptor 10.

The charged photoreceptor surface is next transported to the vicinity of developing apparatus 24. In the preferred embodiment a magnetic brush 22 applies electrified toner particles stored in tray 21 to the photoreceptor surface. The particles of the developer material have an electrostatic charge applied thereto of opposite polarity from the charge of the photoreceptor surface generated by corotron 15. Consequently, as the result of electrostatic forces, toner particles from tray 21 adhere to the surface of the photoreceptor.

The photoreceptor along with the electrostatically coupled toner particles 23 are passed in the vicinity of sensor 25. Sensor 25 is an electrometer probe which, in conjunction with associated electronic circuits included in apparatus 50 measures the electrostatic potential of the photreceptor surface in the vicinity of the probe. The presence of the charged toner particles on the photoreceptor surface will neutralize a portion of the latent electrostatic charge, and the measurements resulting from sensor 20, and associated electronic circuits sensor 25, will generally be different.

In addition to the measurement by sensors 20 and 25 and associated electronic circuits, an optical density measurement is also performed by the apparatus of the preferred embodiment. A light source 28 illuminates, through an optical stop 29 containing an appropriately located aperture, a region 32 of the surface of the photoreceptor. The reflected illumination radiation is focused by means of lens 31, onto photodetecting unit 30. The output signal of the photodetecting unit 30 is applied to electronic apparatus 50. Two measurements of reflectance from the photoreceptor surface are required, one measurement in the presence of the toner particles and one measurement in the absence of the toner particles. The difference in the reflectance measurements and the difference in the electrostatic potential measurements are processed in electronic apparatus 50.

It will be clear to those skilled in the art that, if the normal corotron 15 is utilized in the charging the photoreceptor surface, a region 35, positioned between corotron 15 and developer 24 is available for applying the optical image to be reproduced to the photoreceptor surface. The optical apparatus for imaging illuminating radiation 36 from the image onto the photoreceptor surface can include a rotatable mirror 37 or can be a standard image in an intermodument zone illuminated by primary light source. It can be desirable to determine measurements of the photoreceptor surface in circumstances when the surface is not charged to the normal operating potential. The incomplete charging can result from lowering magnitude the potentials applied between terminals 16, or the charged surface can be partially discharged by positioning mirror 37 to apply an appropriate discharging radiation to surface 35.

Figure 2:
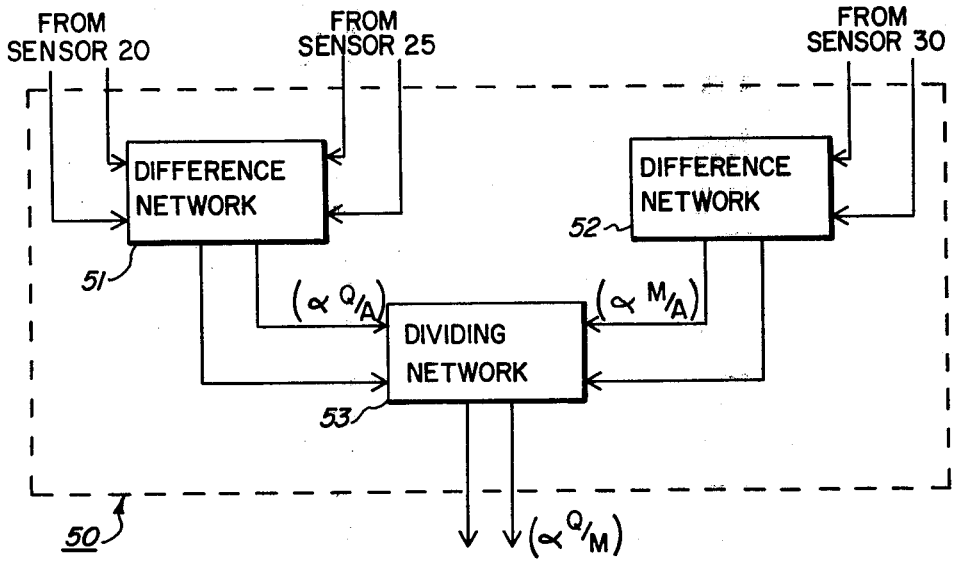
FIG. 2 is a block diagram of apparatus for electrically combining signals produced by the electrostatic potential and the reflectance measurements for providing a signal proportional to the electostatic charged mass ratio of the toner particle material.

Referring now to FIG. 2, a block diagram of the apparatus comprising electronic apparatus 50 is shown. Sensor probe 20 and sensor probe 25 are coupled to difference network 51. Difference network 51 includes electronic circuits for providing a signal determined by the effect of photoreceptor surface electrostatic potential on the probe. The measurements associated with sensor 20 and sensor 25 can be made sequentially with the measurement associated with sensor 20 electronically stored for later comparison with the measurement associated with sensor 25. According to another embodiment, continuous electrostatic field of the photoreceptor surface can be continuously developed by developer 24 and simultaneous measurements can be performed (the developed surface region being cleaned prior to charging by corotron 15). A signal proportional to the difference between the signal associated with sensor 20 and the signal associated with sensor 25 is applied to dividing network 53.

Similarly, output signals from the photodetector unit 30, in the absence of particles adhering to the photoreceptor surface, are applied to input terminals of difference network 52. This quantity can be stored in network 52 until photodetector unit 30 provides a signal to network 52 resulting from reflectance of illumination from the photoreceptor surface in the presence of toner particles. It will be clear that a second photodetecting unit could be employed to monitor a region of the photoreceptor surface to which toner particles are not attached. For example, the second photodetecting unit along with an illuminating radiation source can be positioned to monitor the surface prior to interaction with developer 24, or the second photodetecting unit can monitor the reflectance from a region (i.e. a strip in the direction of photoreceptor propagation of the charged photoreceptor surface which radiation 36, at region 35, has substantially discharged. The use of a second photoreceptor can provide for continuous application of two input signals to network 52. Network 52 determines a difference between the two input signals and applies the resulting difference signal to network 53. The output signal from network 51 is electronically divided by the output signal from network 52 by dividing network 53. As will be described below, the resulting signal is proportional to the ratio of the electrostatic charge to the mass of toner particle material.

Figure 3:
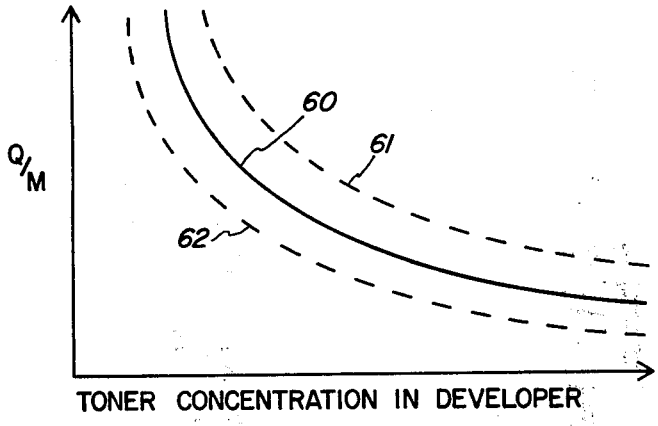
FIG. 3 shows a typical family of curves indicating the relationship between the electrostatic charge to mass ratio of toner particle material and the toner concentration in the development material.

Referring now to FIG. 3, a family of curves demonstrating the relationship between the electrostatic charge to mass ratio of toner particles and the toner particle concentration in the developer material. Curve 60 demonstrates a typical relationship indicating that when the concentration of toner particles in the toner carrier particle mixture of the developer materials is increased the resulting electrostatic charge to mass ratio of the toner particle component decreases. Similarly, curve 61 indicates a similar but displaced relationship which can exist for either lower humidity conditions or for newer developer material. Similarly, curve 62 indicates a similar but oppositely displaced relationship for higher humidity conditions or when the developer material is older than the condition existing for curve 60.

Figure 4:
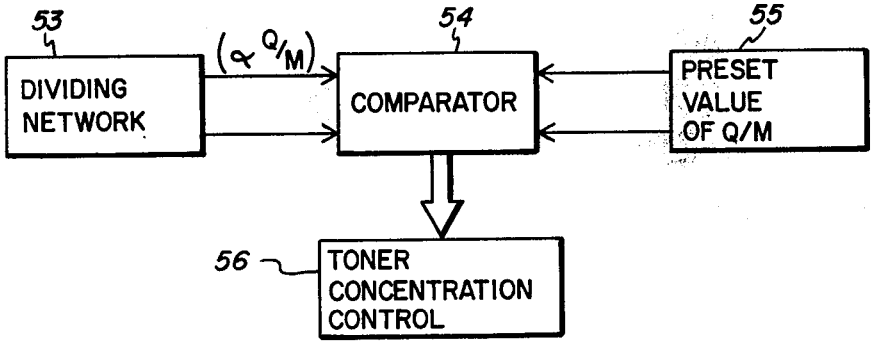
FIG. 4 is a block diagram of apparatus providing feedback control of the electrostatic charge to mass ratio of the toner particle material according to the present invention.

Referring now to FIG. 4, a block diagram of apparatus utilizing the apparatus of the present invention to control the electrostatic charge to mass toner particle material. The output signal of dividing network 53 is applied to comparator 54. Comparator 54 also has applied thereto a reference signal found in network 55. The reference signal of network 55 is a value, which can be determined experimentally, of the toner particle electrostatic charge to mass ratio for which optimum image development was obtained. The differences between the optimum value and the measured value of toner particle charge to mass ratio is applied to network 56. Network 56 includes signal-activated means for changing the ratio of toner to carrier material in the developer material. For example, mechanical gates can be actuated controlling, depending on the sign of the signal from comparator 54, the amount of toner (or the carrier) to be added to the developer material contained on tray 21. It is clear, of course, that correction of the toner concentration can be performed manually.

It has been found that an important parameter in the quality of electrostatographic image reproduction is dependent on, among other parameters, the ratio of electrostatic charge to mass of toner particles. When this ratio can be maintained, reproduction of satisfactory image reproduction is found to be enhanced. The operation of the present invention depends on the result that the difference in reflectance of the radiation from the photoreceptor surface is a function of the mass of toner particles per unit area occupied by the mass, or the density of the toner particles on the photoreceptor surface. Furthermore, the function is a linear relationship for moderately low toner material densities. The use of a less than fully charged photoreceptor surface is provided to permit operation in this linear range.

In addition, the operation of the present invention depends on the result that differences in electrostatic potential of the photoreceptor surface are proportional to charge of the toner particles per unit area. By dividing a quantity proportional to the charge per unit area by a quantity proportional to the mass per unit area, the resulting quantity is proportional to the charge per unit mass, i.e. the ratio the electrostatic charge of the toner particles to the mass of the toner particles (i.e. which carry that charge).

In an operating environment, the accuracy of the present method for determining the ratio can be limited by scavaging which is the carrying away of now neutralized toner particles of charge from the photoreceptor surface producing the neutralization. This limitation on the accuracy, however, can be acceptable when a quantity related to the electrostatic charge to mass ratio, not an absolute value, is utilized. In addition, it is possible to calibrate the present apparatus generally to within the error resulting from the scavaging, by performing a measurement of the electrostatic charge on toner material from developer tray and thereafter measuring the mass, each measurement performed by well-known laboratory techniques. The calibrating measurement can be performed relatively infrequently. Indeed, satisfactory reproduction of latent electrostatic images can be utilized to experimentally determine the desirable signal produced by network 53.

Utilizing the relationship displayed by FIG. 3, i.e. the relationship of the ratio electrostatic charge to mass of toner particle to the toner particle concentration, control of the ratio of charge to mass can be effected. When, because of changes in humidity or aging of developer, a different ratio is produced, the desired ratio can be achieved within limits by altering the concentration of toner particle component in the developer material. A desirable value can be entered manually in network 55. Upon sufficient excursion from the optimum value entered in network 55 by the electronic circuits 50, control apparatus 56 is activated to correct automatically for the departure from optimum oerating value.

The above description is included to illustrate the operation of the preferred embodiment and is not meant to limit the scope of the invention. The scope of the invention is to be limited only by the following claims. A person skilled in the art can readily discern many changes and variations in the above description which are yet within the spirit and scope of the invention.

What is claimed is:

1. In an improved electrostatographic image processing system having a charge storage medium, charging means for placing an electrostatic charge on a surface of said charge storage medium, means for producing a latent electrostatic image on said surface, and a development material for developing said latent electrostatic image on said surface to provide a developed image, said development material including at least a toner component and a carrier component, wherein properties of said developed image are determined by a ratio of electrostatic charge to mass of said toner component wherein the improvement comprises:

means for producing a control signal reflecting said ratio of electrostatic charge to mass of said toner component; and means for controlling the proportion of said toner component in said development material in response to said control signal, said control signal producing means including first apparatus for providing a first signal related to a difference in electrostatic potential of said surface resulting from addition of said toner component to said surface, and second apparatus for providing a second signal related to a difference in optical reflectance of said surface resulting from addition of said toner component to said surface.

2. In an improved electrostatographic image processing system having a charge storage medium, charging means for placing an electrostatic charge on a surface of said charge storage medium, means for producing a latent electrostatic image on said surface, and a development material for developing said latent electrostatic image on said surface to provide a developed image, said development material including at least a toner component and a carrier component, wherein properties of said developed image are determined by a ratio of electrostatic charge to mass of said toner component, wherein the improvement comprises:

means for producing a control signal reflecting said ratio of electrostatic charge to mass of said toner component; and means for controlling the proportion of said toner component in said development material in response to said control signal, said control signal producing means including first apparatus for providing a first signal related to a difference in electrostatic potential of said surface resulting from addition of said toner component to said surface, second apparatus for providing a second signal related to a difference in optical reflectance of said surface resulting from addition of said toner component to said surface, and means for combining said first and said second signals to produce said control signal.

3. The improved electrostatographic image processing system of claim 2 wherein said proportion controlling means responds to said control signal to maintain said ratio of electrostatic charge to mass of said toner component at substantially a predetermined value.

4. Apparatus for controlling the ratio of electrostatic charge to mass for a toner component in a development material utilized in developing an electrostatic latent image on a surface, comprising:

means for generating a first signal related to a change in the electrostatic charge of said surface resulting from addition of said toner component to said surface;

second means for generating a second signal related to a change in optical reflectances from said surface resulting from addition of said toner component to said surface whereby to produce a signal reflecting said toner component mass;

means for combining said first and second second signals to generate a control signal related to the ratio of said change in electrostatic charge to said toner component mass; and means for controlling the proportion of said toner component in said image developing in response to said control signal.

5. The apparatus of claim 4 wherein said controlling means automatically responds to said control signal to produce a change in the proportion of said toner component in said development material in accordance with a change in said ratio.

6. The apparatus of claim 4 including means for storing a predetermined signal related to a desired value of said ratio, said controlling means automatically changing the proportion of said toner component in said development material when said control signal differs from said predetermined signal by a preselected amount.

7. A method for controlling the concentration of toner particles in a development material for developing latent electrostatic images stored on a surface, the surface having been previously charged to a predetermined electrostatic potential and then exposed to form said latent electrostatic images thereon, said surface having a preset optical relectance, comprising the steps of:

a. measuring the change in electrostatic potential of said surface resulting from addition of toner particles to said surface to produce a potential measurement;

b. measuring the change in optical reflectance of said surface resulting from addition of said toner particles to said surface to produce a reflectance measurement;

c. combining said potential measurement and said reflectance measurement to provide a control signal reflecting the ratio of electrostatic charge to mass of said toner particles; and d. determining the concentration of said toner particles in said development material from said combined measurements.

8. The method of controlling toner particle concentration according to claim 7 further including the step of determining an optimum value for said control signal; and controlling said toner particle concentration in response to a difference between said control signal and said optimum value.

9. In an electrostatographic image processing system of the type wherein a latent electrostatic image is generated on a charge bearing surface and thereafter developed by developing material, said developing material including a toner component and at least one other component, and apparatus for maintaining an electrostatic charge to mass ratio of said toner component within predetermined limits comprising:

means for providing a signal indicative of said electrostatic charge to mass ratio of said toner component;

means for comparing said signal to said predetermined limits; and means for changing the concentration of said toner component in said developing material in response to a change of said charge to mass ratio of said toner component, said signal providing means including means for providing a first signal related to the change in electrostatic potential of said charge bearing surface upon addition of said developing material toner component to said surface, and means for providing a second signal related to the change in optical reflectance from said surface upon addition of said developing material toner component to said surface, said signal providing means including means for combining said first and said second signals to produce said signal indicative of said electrostatic charge to mass ratio of said toner component.

10. In an electrostatographic image processing system, of the type wherein a latent electrostatic image is generated on a charge bearing surface and thereafter developed by developer material including a toner component, apparatus for measuring a quantity related to a ratio of electrostatic charge on said surface to mass of the toner component in said developer material, comprising:

means for generating a first signal related to the difference in electrostatic potential of the charge on said surface after developing of said latent electrostatic image thereon with said toner component;

means for generating a second signal related to a difference in reflectance of said surface after developing of said latent electrostatic image thereon with said toner component, and means for generating a control signal determined by dividing said first signal by said second signal.

11. The apparatus of claim 10 wherein said first signal generating means includes at least an electometer, said first signal being related to said difference in the electrostatic potential of said surface resulting from the presence of charged toner particles from said toner component on said surface.

12. In an electrostatographic image processing system, the steps comprising:

a. charging a surface of a medium utilized for storing electrostatic images, b. measuring a first electrostatic potential of said charged surface;

c. measuring a first optical reflectance from said surface;

d. applying charged toner particles to said charged surface;

e. measuring a second electrostatic potential for said surface with said charged toner particles;

f. determining a difference between said first and said second electrostatic potential to provide a potential difference;

g. measuring a second optical reflectance from said surface with said charged toner particles;

h. determining a difference between said first and second optical reflectance to provide an optical reflectance difference; and i. dividing said potential difference by said optical reflectance difference whereby to provide a ratio of electrostatic charge to mass of the toner component in said developing material.

* * * * *